US010297245B1

(12) United States Patent
Chen

(10) Patent No.: US 10,297,245 B1
(45) Date of Patent: May 21, 2019

(54) WIND NOISE REDUCTION WITH BEAMFORMING

(71) Applicant: Cirrus Logic International Semiconductor Ltd., Edinburgh (GB)

(72) Inventor: Hu Chen, Cremorne (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/928,946

(22) Filed: Mar. 22, 2018

(51) Int. Cl.

| | |
|---|---|
| ***H04R 3/00*** | (2006.01) |
| ***G10K 11/178*** | (2006.01) |
| ***G10L 25/84*** | (2013.01) |
| ***H04R 1/40*** | (2006.01) |

(52) U.S. Cl.
CPC ..... *G10K 11/17853* (2018.01); *G10L 25/84* (2013.01); *H04R 1/406* (2013.01); *H04R 3/005* (2013.01); *G10K 2210/1082* (2013.01); *G10K 2210/3028* (2013.01); *H04R 2410/07* (2013.01)

(58) Field of Classification Search
CPC ..... H04R 1/406; H04R 1/1083; H04R 3/005; H04R 2410/05; H04R 2410/07; G10K 11/17853; G10K 11/17854; G10K 11/175; G10K 2210/1082; G10K 2210/3028; G10K 11/34; G10K 2200/10; G10L 25/84
USPC ..... 381/71.6, 71.1, 71.9, 71.12, 94.1
See application file for complete search history.

(56) References Cited

U.S. PATENT DOCUMENTS

2009/0175466 A1 7/2009 Elko et al.
2012/0123771 A1* 5/2012 Chen ..... G10L 21/0208 704/226
2013/0117014 A1* 5/2013 Zhang ..... G10L 21/00 704/207

FOREIGN PATENT DOCUMENTS

| | | | |
|---|---|---|---|
| WO | 2005055644 | A1 | 6/2005 |
| WO | 2015003220 | A1 | 1/2015 |
| WO | 2015179914 | A1 | 12/2015 |

OTHER PUBLICATIONS

Griffiths, L. et al., An Alternative Approach to Linearly Constrained Adaptive Beamforming, IEEE Transactions on Antennas and Propagation, vol. AP-30, No. 1, Jan. 1982.

(Continued)

*Primary Examiner* — Ahmad F. Matar
*Assistant Examiner* — Sabrina Diaz
(74) *Attorney, Agent, or Firm* — Jackson Walker L.L.P.

(57) ABSTRACT

A device for wind noise reduction and spatial noise reduction comprises a first microphone for capturing a nominal speech signal, and a second microphone for capturing a nominal noise signal. The device has a generalized sidelobe canceller for spatial noise reduction, comprising a blocking matrix filter configured to adaptively process the nominal speech signal to produce a speech cancellation signal, a first subtraction node for subtracting the speech cancellation signal from the nominal noise signal to produce a noise reference signal, a noise cancellation filter configured to adaptively filter the noise reference signal to produce a noise cancellation signal, and a second subtraction node for subtracting the noise cancellation signal from the nominal speech signal to produce a speech reference signal. The device has a wind noise reduction module for wind noise reduction, the wind noise reduction module comprising at least one filter derived from the blocking matrix filter of the generalized sidelobe canceller.

20 Claims, 6 Drawing Sheets

(56) References Cited

OTHER PUBLICATIONS

Norcross, Scott G. et al., Inverse Filtering Design Using a Minimal Phase Target Function from Regularization, Audio Engineering Society, Convention Paper 6929, 121st Convention, Oct. 5-8, 2006, San Francisco CA.

Kirkeby, Ole et al., Fast deconvolution of multichannel systems using regularization, IEEE Transactions on Speech and Audio Processing, vol. 6, No. 2, Mar. 1998.

Kirkeby, Ole et al., Digital Filter Design for Inversion Problems in Sound Reproduction, J. Audio Eng. Soc. vol. 47, No. 7/8, Jul./Aug. 1999.

* cited by examiner

WIND NOISE REDUCTION WITH BEAMFORMING

FIELD OF THE INVENTION

The present invention relates to the digital processing of signals from microphones or other such transducers, and in particular relates to a device and method for efficiently mixing multiple such signals in order to reduce wind noise, in conjunction with an adaptive directional beamformer.

BACKGROUND OF THE INVENTION

Processing signals from microphones in consumer electronic devices such as smartphones, hearing aids, headsets and the like presents a range of design problems. There are usually multiple microphones to consider, including one or more microphones on the body of the device and one or more external microphones such as headset or hands-free car kit microphones. In smartphones these microphones can be used not only to capture speech for phone calls, but also for taking an audio recording such as for voice notes or to accompany video capture. Increasingly, more than one microphone is being provided on the body of such devices, for example to improve noise cancellation.

Audio usage scenarios can be numerous in the case of a smartphone or tablet with an applications processor. For example, telephony functions should include a side tone so that the user can hear their own voice, noise reduction, and acoustic echo cancellation. Jack insertion detection should be provided to enable seamless switching between internal to external microphones when a headset or external microphone is plugged in or disconnected.

Consequently, a range of audio digital signal processing applications involve the mixing of signals from multiple microphones, whether across the full audio band or in selected frequency subbands. Adaptive directional beamforming is one such application, and involves the signals from two or more microphones being mixed in a manner to maintain gain in a direction of interest (typically being the forward direction of the listener), while adaptively nulling ambient background noise from other directions, such as conversations occurring behind or to the side of the listener. A generalized sidelobe canceller (GSC) of any suitable configuration can for example be used for this purpose. Adaptive directional beamforming works to null signals coming from a particular direction, such as background speech, and in particular this approach only works on such correlated signals.

However wind noise detection and reduction is a particularly difficult problem in devices with microphones. Wind noise is defined herein as a microphone signal generated from turbulence in an air stream flowing past microphone ports, as opposed to the sound of wind blowing past other objects such as the sound of rustling leaves as wind blows past a tree in the far field. Wind noise can be objectionable to the user, can mask other signals of interest, and can corrupt the device's ability to suppress background noise sources by beamforming. It is desirable that digital signal processing devices are configured to take steps to ameliorate the deleterious effects of wind noise upon signal quality. However, when wind noise is present, existing devices typically simply revert adaptive directional beamforming to an omnidirectional state by use of a primary microphone only. This is because the beamforming function cannot identify and thus cannot null a direction of origin of wind noise because wind noise is uncorrelated between microphones. Instead, disadvantageously, beamforming functions are usually corrupted by wind noise and will typically respond inappropriately by actually amplifying uncorrelated noise such as wind noise. It is for this reason that existing devices tend to simply disable beamforming in the presence of wind noise and revert to a primary microphone and omnidirectional operation.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect, the present invention provides a device for wind noise reduction and spatial noise reduction, the device comprising:

a first microphone for capturing a nominal speech signal;

a second microphone for capturing a nominal noise signal;

a generalised sidelobe canceller for spatial noise reduction, comprising:

- a blocking matrix filter configured to adaptively process the nominal speech signal to produce a speech cancellation signal;
- a first subtraction node for subtracting the speech cancellation signal from the nominal noise signal to produce a noise reference signal;
- a noise cancellation filter configured to adaptively filter the noise reference signal to produce a noise cancellation signal; and
- a second subtraction node for subtracting the noise cancellation signal from the nominal speech signal to produce a speech reference signal; and a wind noise reduction module for wind noise reduction, the wind noise reduction module comprising at least one filter derived from the blocking matrix filter of the generalised sidelobe canceller.

According to a second aspect, the present invention provides a method for wind noise reduction and spatial noise reduction, the method comprising:

capturing a nominal speech signal from a first microphone;

capturing a nominal noise signal from a second microphone;

providing a generalised sidelobe canceller for spatial noise reduction which performs the steps of:

- adaptively processing the nominal speech signal with a blocking matrix filter, to produce a speech cancellation signal;
- subtracting the speech cancellation signal from the nominal noise signal to produce a noise reference signal;

adaptively filtering the noise reference signal with a noise cancellation filter, to produce a noise cancellation signal; and subtracting the noise cancellation signal from the nominal speech signal to produce a speech reference signal; and applying wind noise reduction using at least one filter derived from the blocking matrix filter of the generalised sidelobe canceller.

According to a third aspect, the present invention provides a system for wind noise reduction and spatial noise reduction comprising a processor and a memory, the memory containing instructions executable by the processor and wherein the system is operative to capture a nominal speech signal from a first microphone;

capture a nominal noise signal from a second microphone;

provide a generalised sidelobe canceller for spatial noise reduction which performs the steps of:

adaptively processing the nominal speech signal with a blocking matrix filter, to produce a speech cancellation signal;

subtracting the speech cancellation signal from the nominal noise signal to produce a noise reference signal;

adaptively filtering the noise reference signal with a noise cancellation filter, to produce a noise cancellation signal; and subtracting the noise cancellation signal from the nominal speech signal to produce a speech reference signal; and apply wind noise reduction using at least one filter derived from the blocking matrix filter of the generalised sidelobe canceller.

In some embodiments of the invention, microphone matching is performed by applying a microphone matching filter $H_{match}$ to the noise reference signal, and wherein $H_{match}$ is derived by inverting an adaptive block matrix filter $H_{BM}$. In such embodiments of the invention, $H_{match}$ may be scaled by a weight B, B being derived to minimise a power of the output signal of the wind noise reduction module to thereby effect wind noise reduction. For example, in such embodiments, a filter $H_d$ may be applied to the speech reference signal by the wind noise reduction module, the filter $H_d$ comprising a short filter or a pure delay.

In some embodiments of the invention, microphone matching is effected by the at least one filter of the wind noise reduction module, and no separate microphone matching module is provided.

In some embodiments of the invention a wind noise detector is also provided, and wherein the speech reference signal is passed to an output when wind is not detected, and wherein an output of the wind noise reduction module is passed to the output when wind is detected.

In some embodiments of the invention, microphone matching is performed by applying a microphone matching filter $H_{match}$ to an output of the wind noise reduction module, wherein $H_{match}$ is derived by inverting an adaptive block matrix filter ha, and wherein inputs to the wind noise reduction module comprise the speech reference signal filtered by hit and the noise reference signal, and wherein the wind noise reduction module applies a weight B to the noise reference signal before mixing the inputs.

The system in some embodiments may be a headset, an earbud or a smartphone.

The present invention thus provides for one or more outputs or intermediate signals of a blocking matrix of a generalised sidelobe canceller to be used as inputs to a wind noise reduction module. This confers the important benefit of eliminating at least one filter and thus reducing computational complexity. This also means that the noise cancellation filter of the generalised sidelobe canceller and the wind noise reduction module share the same inputs, permitting other computational steps to also be shared, further reducing computational complexity.

BRIEF DESCRIPTION OF THE DRAWINGS

An example of the invention will now be described with reference to the accompanying drawings, in which.

Corresponding reference characters indicate corresponding components throughout the drawings.

DETAILED DESCRIPTION OF PREFERRED EMBODIMENTS

Figure 1:
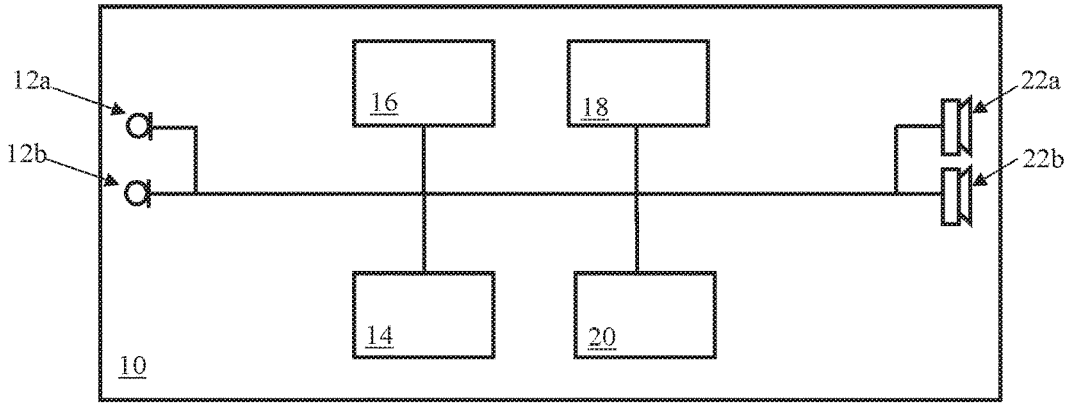
FIG. 1 is a schematic diagram illustrating components of a smartphone.

FIG. 1 is a schematic diagram illustrating various interconnected components of a smartphone 10 in accordance with an embodiment of the present invention. It will be appreciated that the smartphone 10 will in practice contain many other components, but the following description is sufficient for an understanding of the present invention. The smartphone 10 is provided with multiple microphones 12*a*. 12*b*, etc. Such microphones may be positioned upon a body of the smartphone and/or upon a headset which captures one or more microphone signals which are passed to the smartphone 10. For example microphones 12*a*, 12*b* etc. may comprise one or more pendant microphones or earbud microphones of a wired headset, one or more boom microphones, or wireless headset microphones, from which the respective microphone signals are each passed to the smartphone 10.

Smartphone 10 further comprises a memory 14 which may in practice be provided as a single component or as multiple components. The memory 14 is provided for storing data such as audio data, program instructions and filter parameters. Processor 16 may in practice be provided as a single component or as multiple components. For example, one component of the processor 16 may be an applications processor of the smartphone 10. FIG. 1 also shows a transceiver 18, which is provided for allowing the smartphone 10 to communicate with external networks. For example, the transceiver 18 may include circuitry for establishing an internet connection either over a WiFi local area network or over a cellular network. FIG. 1 also shows audio processing circuitry 20 for performing operations on audio signals, such as stereo audio signals held in memory 14 or received via transceiver 18 or detected by the microphones 12*a* and 12*b*.

In particular the audio processing circuitry 20 is configured to apply beamforming and subband wind noise reduction to audio signals captured by microphones 12, 12*b*, as discussed in more detail in the following, but may also filter the audio signals or perform other signal processing operations. While in this embodiment the present invention is deployed on a smartphone 10, it is to be appreciated that alternative embodiments may be deployed on any other suitable audio processing platform requiring such functions, including for example a headset of any suitable form factor such as earbuds, a boom microphone headset, a neckband headset or an over-the-ear headset.

Beamforming is widely used in multi mic handset and headset products to improve the signal to noise ratio, by cancelling the correlated noise signals. One popular beamforming structure is the Generalized Sidelobe Canceller (GSC), which is typically configured to use one of the microphone signals (12*a*, 12*b*) as a primary signal, typically being the microphone closest to the user's mouth. Another microphone signal, typically being taken or derived from a microphone which is positioned further from the user's mouth or which is otherwise configured to more strongly represent background noise, is used by the GSC as a noise input. The GSC module contains an adaptive block matrix (ABM) and an adaptive interference canceller (AIC), which operate upon the primary microphone signal and the noise microphone signal in a manner which seeks to adaptively implement beamforming in a manner which minimises background noise and maximises the user's voice signal in the filtered primary microphone signal output by the GSC. In particular, the ABM is typically configured to provide more than 10 dB attenuation on a target signal, and steers a null in the direction of the target.

In general, the proposed structure for wind noise reduction (WNR) in accordance with the presently described embodiment of the invention uses the filtered primary microphone signal output by the GSC and the noise reference signal from the ABM of the GSC as inputs to the wind noise reduction (WNR) module. Notably, using the ABM output in this manner reduces the number of computing instructions and the memory consumption in the DSP 20 of the smartphone 10, and moreover this configuration also matches microphone sensitivity for target speech more precisely than is the case for mic-matching modules in other architectures.

Figure 2:
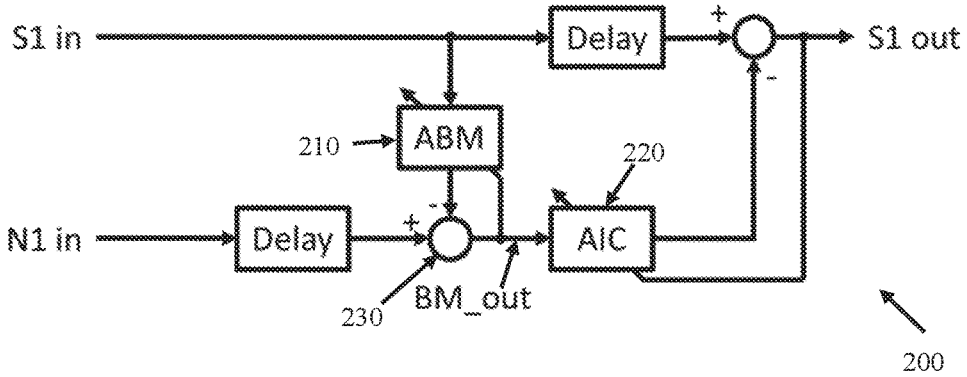
FIG. 2 illustrates a two microphone GSC structure in accordance with an embodiment of the present invention.

In more detail, FIG. 2 illustrates a two microphone GSC structure in accordance with an embodiment of the present invention, as may for example be implemented on the smartphone platform of FIG. 1. FIG. 2 plots the structure of the GSC component, of the GSC plus WNR architecture being described. S1 and N1 are the input microphone signals derived from microphones 12*a*, 12*b* etc. as described above. Generally we name the microphone closer to the mouth as S1 and the microphone further away from the mouth as N1. The ABM 210 and AIC 220 are configured produce the best possible noise reference, by subtracting the matched speech signal from N1. The AIC reduces noise in the BM_out signal by subtracting the noise signal component that is correlated to the noise reference from the delayed S1 signal in noisy conditions.

Delays are added in both the ABM 210 and AIC 220 to ensure the designed filters are causal. In FIG. 2, BM_out is the signal produced by subtracting the ABM 210 output from the noise reference N1. In the frequency domain, this is represented as:

$$BM_\text{out}(w)=N1(w)-H_{BM}(W)*S1(w) \tag{1}$$

where w is the angular frequency.

We denote $H_{BM}$ to represent the frequency domain adaptive filter in the ABM 210. The ABM 210 in essence tracks the speech transfer function from S1 to N1. In the time domain, the result of subtracting the output of the ABM 210 from the input noise reference N1 is:

$$bm_\text{out}(n)=n1(n)-h_{BM}(s1(n)) \tag{2}$$

Ideally, BM_out is close to zero for the target speech. That is:

$$N1(w)\approx H_{BM}(W)*S1(w) \tag{3}$$

The present embodiment further provides for the implementation of microphone matching, prior to wind noise reduction. A suitable microphone matching filter $H_{match}$ is a filter causes the filtered N1 to match S1, in speech. That is:

$$S1(w)\approx H_{match}(W)*N1(w) \tag{4}$$

From (3) and (4), the present inventors recognise that the microphone matching filter $H_{match}$ is simply the inverse of $H_{BM}$. That is, $$H_{match}(W)*H_{BM}(w)=H_d(w) \tag{5}$$

where $H_d(w)$ is the desired response of the system.

In this case, $H_d(w)=1$.

Filter inversing, although not always trivial, can be effected when noting the following considerations. In carrying out inverse filter design, it is noted that normally beamforming has an adaptive filter that tracks the transfer function for speech between the microphone signals, from S1 to N1, in order to produce a noise reference, for example the adaptive block matrix (ABM) in the general Sidelobe canceller (GSC) as described. By inversing this transfer function, we can derive the transfer function from N1 to S1 as referred to in equation (5) above. The benefit of using such an ABM filter is that it is adaptive. In typical use scenarios of handsets and headsets, users hold the device differently, while hand movement also causes changes in the transfer function of the speech from S1 to N1. In headsets, head movement also causes changes of the transfer function. Furthermore, the ABM filter compensates the microphone sensitivity difference. For these reasons, it is not possible to design a suitable fixed inversion filter offline.

Ideally the inverse filter has the inversed frequency response of the transfer FIR filter, so that the desired response $H_d$ is just pure delay. But not all filters are invertible. For example, [0 1 1 0] has a zero in its frequency response. By perfectly inversing this filter, infinity gain needs be applied on that frequency. Therefore, in embodiments of the present invention, regularization is applied on the filter inversion to prevent any requirement of infinity gain. Regularization not only controls the balance between performance error and output power, but also the duration or length of the designed filter.

A simple method to construct the inverse filter is described in International Patent Publication No WO2015179914, the content of which is incorporated herein by reference. That method assumes the transfer function as fullband attenuation and delay and gives a suitably accurate result when the distance between microphones is small.

Figure 3:
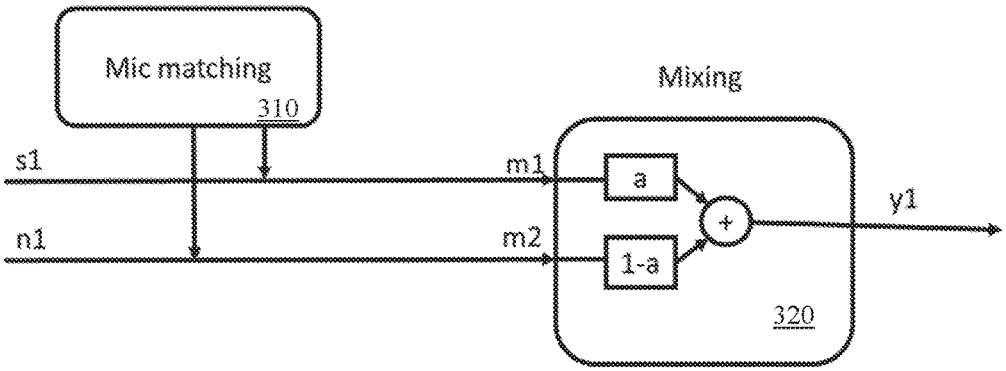
FIG. 3 illustrates a two microphone SWNR structure in accordance with a prior approach.

The present embodiment of the invention further provides for Subband Wind Noise Reduction (SWNR). FIG. 3 illustrates a two microphone SWNR structure, in which the SWNR is carried out by applying respective weights a and (1−a) to the two microphone signals. The weights a and (1−a) are determined in accordance with the teachings of WO2015179914. Before the mixing, microphone matching is applied by mic matching module 310 to the S1 and N1 microphone signals, in order to match the signals in respect of the target speech. Then the matched signals m1 and m2 are mixed in the SWNR module 320 to generate the output signal y1. In the frequency domain (we omit w from this notation):

$$Y1 = A * M1 + (1 - A) * M2 \tag{6}$$

$$A = \frac{\sum |M2|^2 - \text{real}\left(\sum M1 * \overline{M2}\right)}{\sum |M1|^2 - 2 * \text{real}\left(\sum M1 * \overline{M2}\right) + \sum |M2|^2}, \; -1 \le A \le 1 \tag{7}$$

where $\bar{y}$ is the complex conjugate of y, |y| is the absolute value of y and real( ) is a function that returns the real part of the complex input parameter, as discussed further in WO2015179914.

Figure 4:
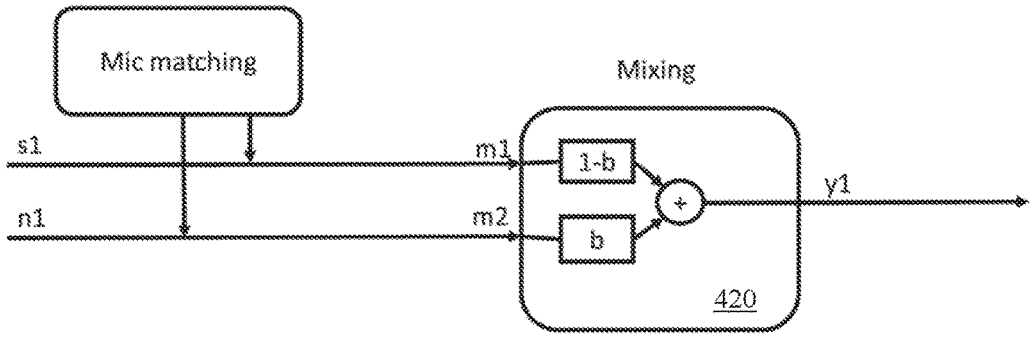
FIG. 4 illustrates an implementation of SWNR in accordance with a prior approach.

FIG. 4 illustrates an alternative representation of SWNR to assist in illustrating the derivation of the present invention. Here we change the structure of the SWNR, and apply $H_{match}$ on N1. Thus, the output Y1 in the embodiment of FIG. 4 is:

$$Y1=(1-B)*S1*H_d+H_{match}*B*N1; \tag{8}$$

By rewriting (8), and from (5) and (1), it can be noted that:

$$Y1=S1*H_d+H_{match}*B*(N1-H_{BM}*S1) \tag{9}$$

$$Y1=S1*H_d+H_{match}*B*BM_\text{out} \quad \text{(9a) or}$$

$$Y1=H_{match}*(H_{BM}*S1+B*BM_\text{out}) \tag{9b}$$

By minimizing the power of the output Y1, for the reasons discussed in WO2015179914, we derive the optimal weight B:

$$B = \frac{-\text{real}(H_{BM} * S1 * \overline{\text{BM_out}})}{|\text{BM_out}|^2}, \; -1 \le B \le 1 \tag{9c}$$

Figure 5:
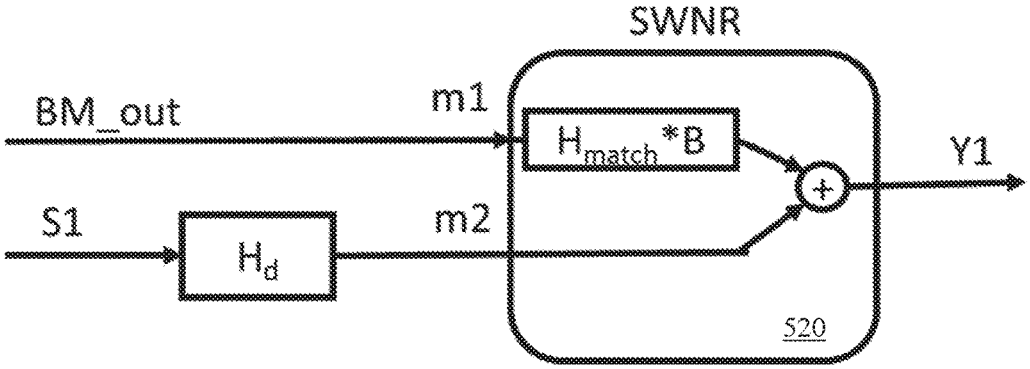
FIG. 5 illustrates implementation of two microphone subband wind noise reduction in accordance with a first embodiment of the invention.
Figure 6:
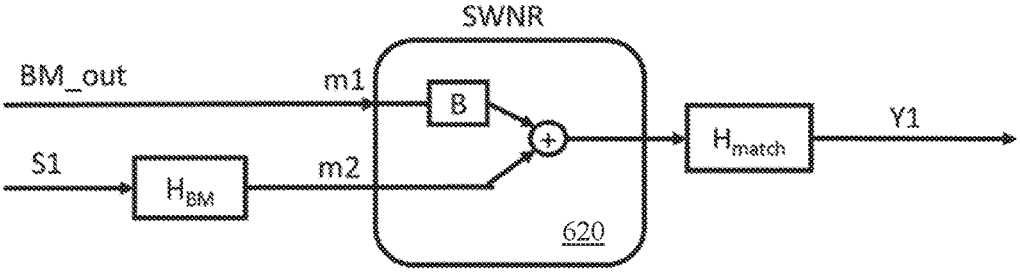
FIG. 6 illustrates implementation of two microphone subband wind noise reduction in accordance with a second embodiment of the invention.

FIG. 5 illustrates implementation of equation 9a in accordance with a first embodiment of the invention, and FIG. 6 illustrates the implementation of equation 9b in accordance with a second embodiment of the invention.

Notably, in the embodiments of FIGS. 5 and 6, no microphone matching block is required.

The embodiments of FIGS. 5 and 6 further provide that the SWNR module 520, 620 is presented with signals derived from BM_out and S1, from the GSC 200. This is in contrast to the past approach of presenting the SWNR module 320 with signals derived from S1 and N1, as shown in FIG. 3.

Referring again to FIG. 2, the present inventors note that $H_{BM}$*S1 is already calculated, by the ABM block 210 in the GSC module 200. The embodiments of the invention shown in FIGS. 5 and 6 exploit this insight by using only one mixing filter on the two inputs, neglecting filter $H_d$ in FIG. 5, which is normally short or even just a pure delay. The microphone matching filter $H_{match}$ in the embodiment of FIG. 5 needs to be fairly accurate since it affects the calculation of the mixing coefficient.

In FIG. 6, the filter $H_{match}$ only affects the frequency response of the output. Its filter length depends on the inverse filter design discussed later.

Figure 7:
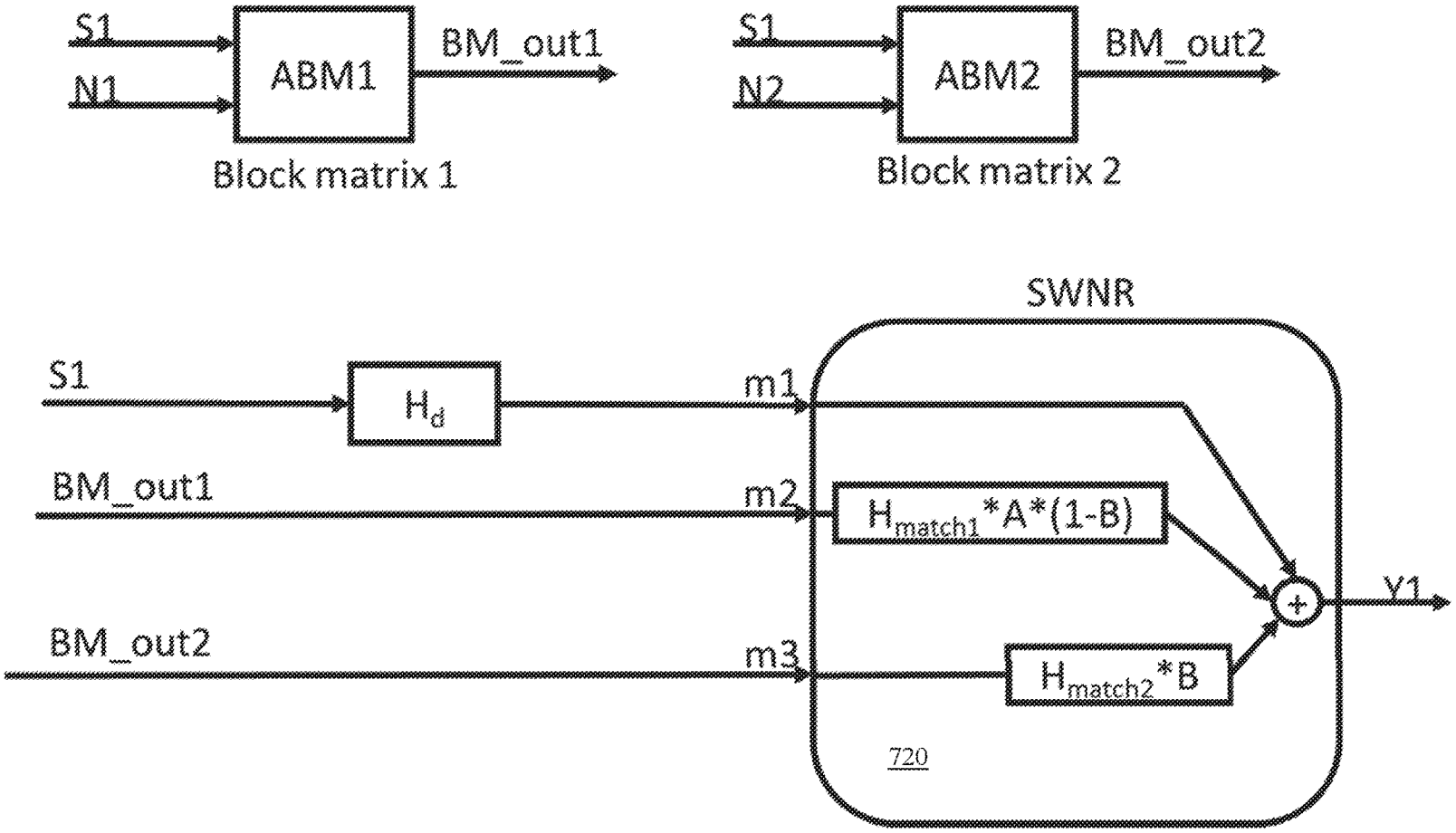
FIG. 7 illustrates another embodiment of the invention, providing three-microphone subband wind noise reduction.

FIG. 7 illustrates another embodiment of the invention, providing three-microphone subband wind noise reduction. We derive the equations for this 3-mic case using the same insights explained above, as illustrated schematically in FIG. 7.

$$Y1=S1*H_d+H_{match1}*A*(1-B)*BM_\text{out1}+H_{match2}*B*BM_\text{out2} \tag{10a}$$

where BM_out1 and BM_out2 are the block matrix outputs from 2 block matrices in a GSC module; A and B are mixing coefficients; $H_{match1}$ and $H_{match2}$ are mic matching filters; and $H_{BM1}$ and $H_{BM2}$ are adaptive filters in the block matrix.

In turn, we deduce that:

$$\text{BM_out1}(w) = N1(w) - H_{BM1}(w) * S1(w) \tag{10b}$$

$$\text{BM_out2}(w) = N2(w) - H_{BM2}(w) * S1(w) \tag{10c}$$

$$A = \frac{-\text{real}(H_{BM1} * S1 * \overline{\text{BM_out1}})}{|\text{BM_out1}|^2}, \; -1 \le A \le 1 \tag{10d}$$

$$B = \frac{-\text{real}(H_{BM2} * M * \overline{\text{BM_out2}})}{|\text{BM_out2}|^2}, \; -1 \le B \le 1 \tag{10e}$$

$$M = S1 * H_d + H_{match1} * \text{BM_out1} \tag{10f}$$

$$H_d = H_{BM1} * H_{match1} \tag{10g}$$

$$H_d = H_{BM2} * H_{match2} \tag{10h}$$

FIG. 7 shows the resultant form of the three-microphone SWNR module, which again requires no microphone matching pre-stage, and also requires full filters on only 2 out of the three inputs m1, m2, m3, and also provides for such filters to be simply generated off the back of computational work already done in the GSC. Once again, these benefits arise because the conventional approach of passing S1, N1 and N2 to the SWNR is replaced in the present embodiment by instead passing S1, BM_out1 and BM_out2 to the SWNR 720.

Figure 8:
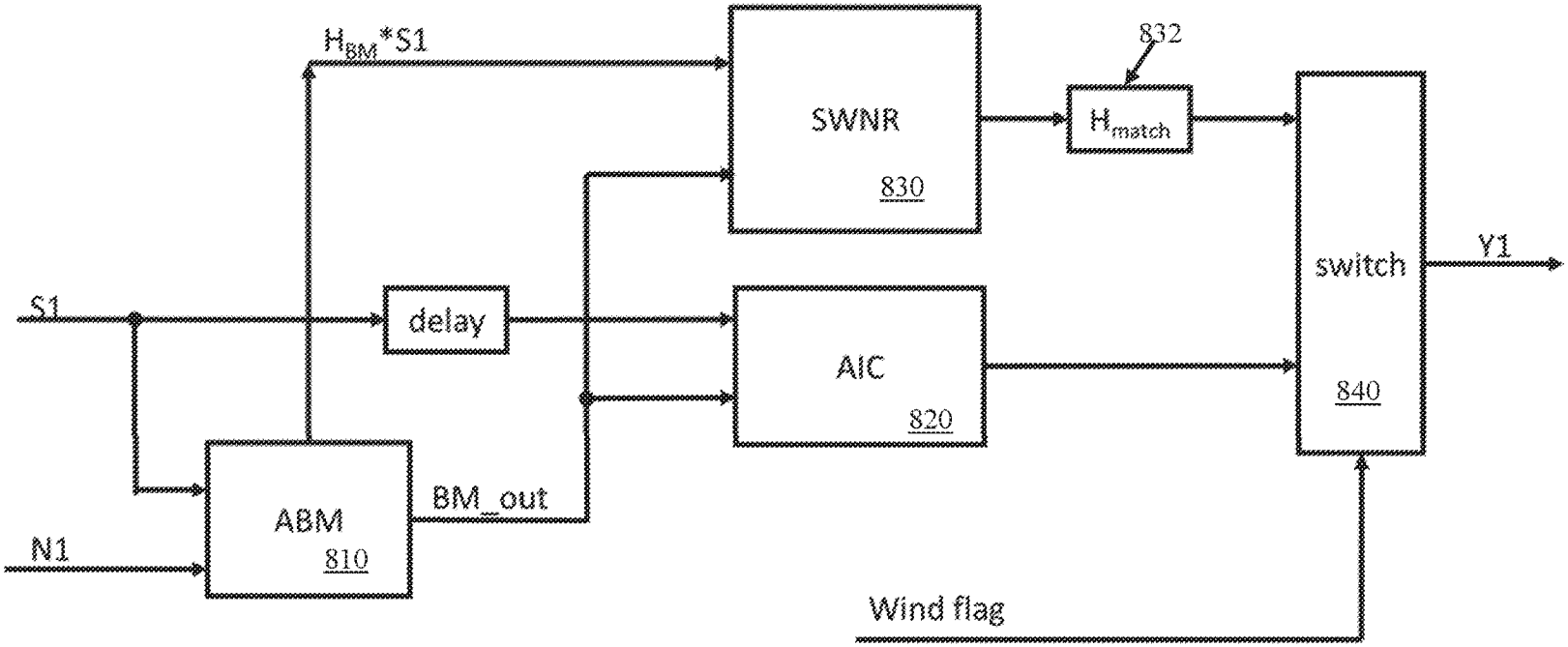
FIG. 8 illustrates the integration of the GSC with the SWNR of FIG. 6.

FIG. 8 illustrates the integration of the GSC 200 with the SWNR of FIG. 6. The inputs to the ABM 810 are microphone signals S1 and N1. The outputs of ABM 810 are the noise reference BM_out and the filtered S1, $H_{BM}$*S1. As usual in a GSC, the noise reference BM_out is passed to the AIC 820. Additionally, in accordance with the present invention, the noise reference BM_out is also copied to the SWNR module 830, and also the filtered S1, $H_{BM}$*S1, is passed to the SWNR module 830.

When wind is not present. AIC 820 uses the noise reference BM_out to cancel the noise in the delayed S1 signal. When wind is present, SWNR 830 mixes the filtered S1 signal ($H_{BM}$*S1) with the noise reference BM_out using the mixing coefficient B. The result is then filtered by $H_{match}$ 832. The switch 840 is controlled by an external wind flag produced by any suitable wind noise detector (not shown), such as a wind noise detector in accordance with the teachings of WO2016011499, the content of which is incorporated herein by reference. We expect the outputs of $H_{match}$ 832 and AIC 820 to be synchronized, so $H_d$ in equation (5) in the embodiment of FIG. 8 is simply a pure delay.

Figure 9:
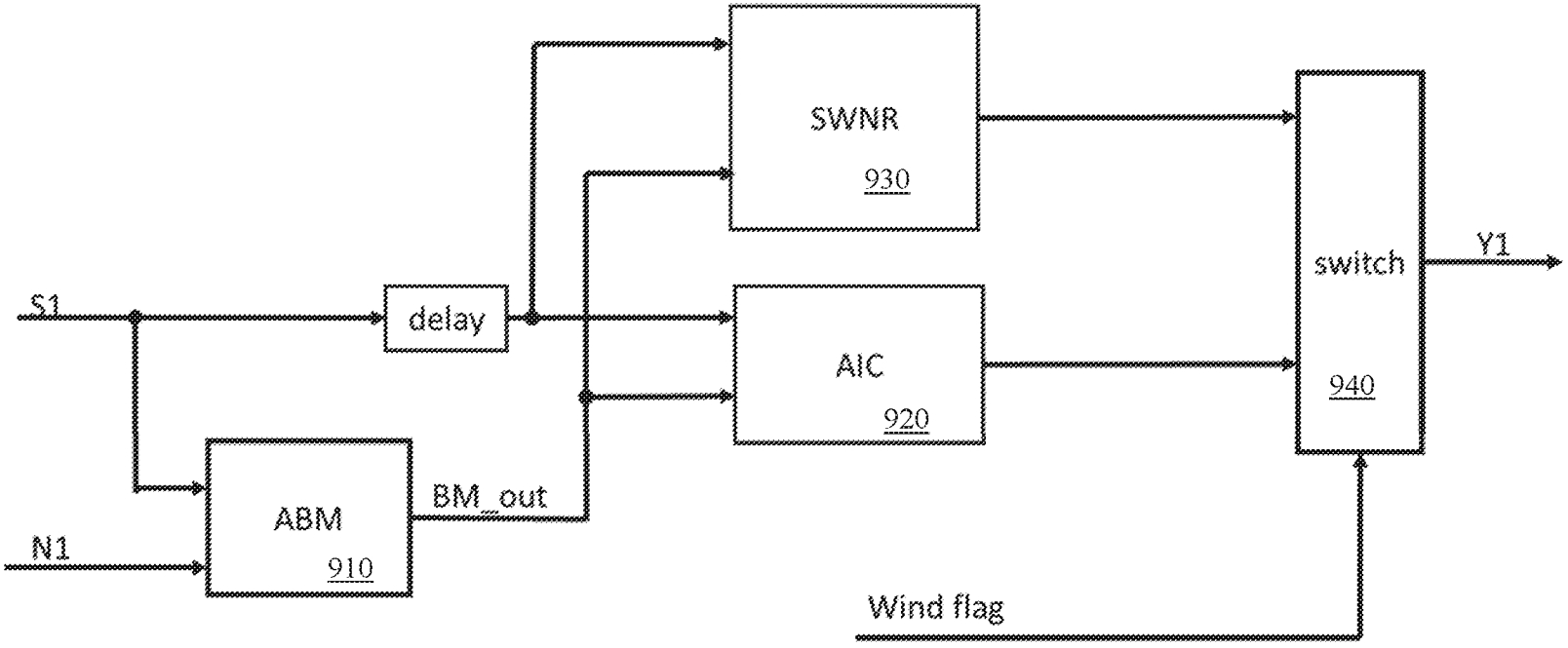
FIG. 9 illustrates the integration of the GSC with the SWNR of FIG. 5.

FIG. 9 illustrates the integration of the GSC 200 with the SWNR of FIG. 5. The inputs to the ABM 910 are microphone signals S1 and N1. The output of ABM 910 is the noise reference BM_out. When wind is not present, AIC 920 uses the noise reference BM_out to cancel the noise in the delayed S1 signal. When wind is present, SWNR 930 mixes the delayed S1 signal with the noise reference BM_out using the above-described mixing coefficient $H_{match}$*B. The switch 940 is controlled by any suitable external wind detection flag. We expect the outputs of SWNR 930 and AIC 920 to be synchronized, so $H_d$ in equation (5) in the embodiment of FIG. 9 is simply a pure delay.

Figure 10:
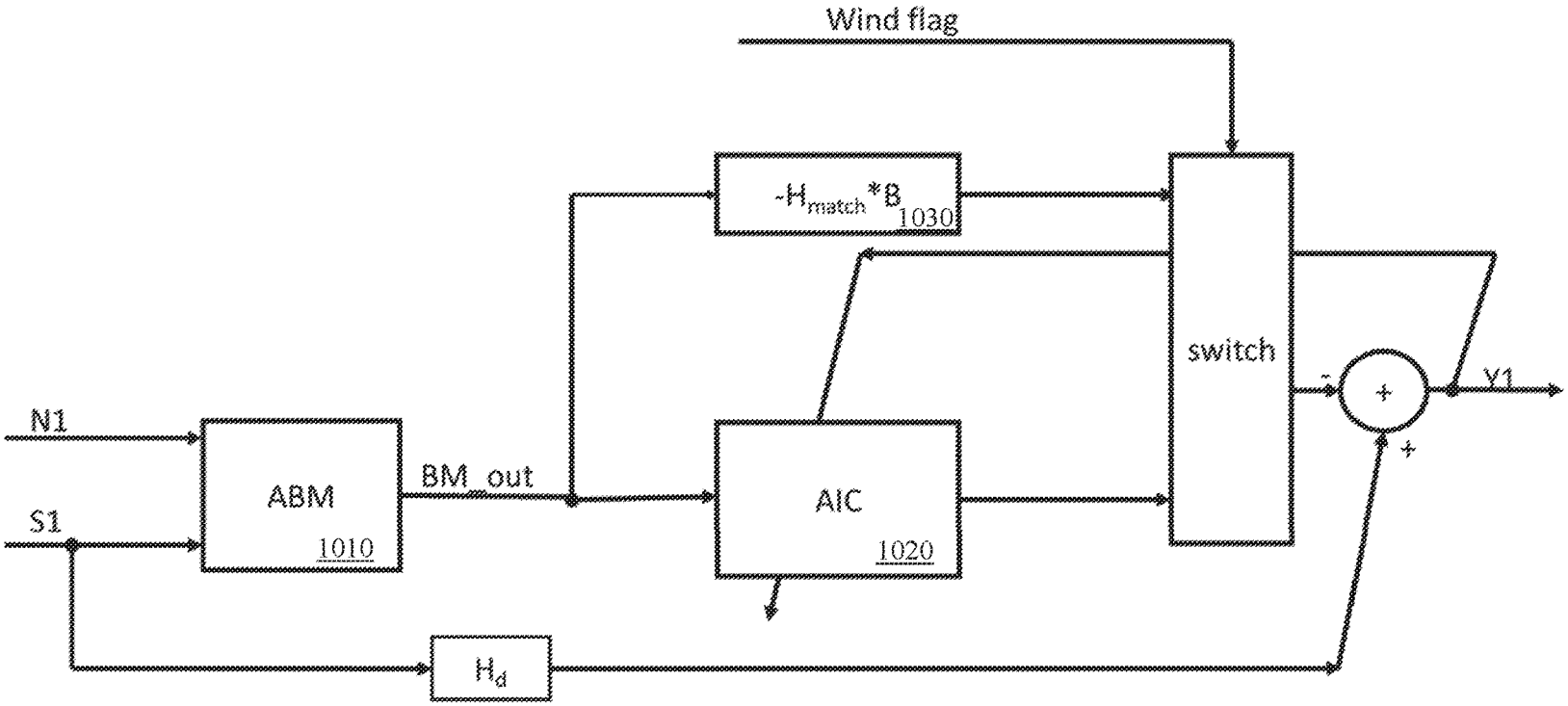
FIG. 10 illustrates integration of the GSC with SWNR in accordance with another embodiment of the invention.

FIG. 10 illustrates integration of the GSC 200 with SWNR in accordance with another embodiment of the invention. In this embodiment, when the wind flag indicates that wind is not present, the BM_out from ABM 1010 is filtered using the AIC filter 1020. The output Y1 comprises $H_d$*S1 minus the filtered BM_out. Y1 is also used for AIC filter 1020 adaptation. When wind is present, the adaptation of AIC 1020 is frozen. The BM_out from ABM 1010 is filtered at 1030 using the negative of the SWNR filter. The output Y1 is $H_d$*S1 minus the filtered BM_out. Since the AIC 1020 and SWNR 1030 are not active simultaneously, a further efficiency can be provided and they can share the same filter, whereby different filter taps are loaded into the shared filter depending on whether wind is detected by the wind flag. In another example, the filter taps can be controlled so as to crossfade between those produced by SWNR 1030 and those produced by AIC 1020, using any suitable cross fading technique, as the wind flag detection condition changes.

A three microphone integration based on the embodiment of FIG. 7 can also be presented. Such an integration is similar to the two microphone configuration of FIG. 10, but will instead comprise two AIC adaptive filters and 2 SWNR filters. Again, since the AIC filters and SWNR filters are not active simultaneously, they can again share the same filter provided that the different filter taps are loaded in different wind conditions. Or, again, filter taps can crossfade from one to another one when wind condition changes.

In considering the computational efficiencies achieved by the presented embodiments of the invention, we consider a frame size of 64 samples which is about 4 ms at 16,000 Hz sampling rate. The FFT size is twice the frame size which is 128 samples. We assume the DSP can calculate multiplication in one cycle and thus will treat +, − and * as one instruction, whereas division may take a few instructions.

Both the prior approach of FIG. 3, and the described embodiments, all need to calculate the mic matching filter $H_{match}$.

When considering the matching filter it is noted that the mic matching filter should be short, for example, only having 10 filter taps since we are not trying to find the exact inverse of BM filter. So for every frame, the matching filter of 10 taps long uses 64*10 multiplication and 64*10 addition. The prior approach of FIG. 3 needs to apply the matching filter to one of the signals. In the embodiment of FIG. 5, the matching filter is merged into the mixing filter so it does not require standalone match filter and thus eliminates the attendant instructions. The embodiment of FIG. 6 applies the matching filter to the output, however $H_{BM}$*S1 is already calculated and buffered in ABM 810 so deriving the filter HA, does not require extra computational cost.

When calculating mixing coefficients in the SWNR, this module needs 2 FFTs for the input signals and 1 IFFT for the filter design. Each FFT/IFFT requires a number of instructions of the order of 128 log 128 which is about 7*128 instructions. The prior approach of FIG. 3 needs 2 FFTs and 1 IFFT, whereas the embodiments of FIGS. 5/9 and 6/8 may share the FFT with the GSC algorithm depending how GSC is implemented. For example, if ABM 810 is implemented in the frequency domain, the FFT of the primary mic signal S1 is calculated in ABM 810. If AIC 820 is implemented in the frequency domain, the FFT of the noise reference BM_out is calculated in AIC 820, presenting opportunities for computational efficiency in SWNR 830.

The mixing ratio A or B is calculated per frequency bins, and the number of frequency bins is half of the FFT size which is 64. Calculating the coefficient A requires 13*64 +/−/* instructions and 64 division instructions. Calculating the coefficient B for the embodiment of FIG. 6 requires 12*64 +/−/* instructions and 64 division instructions. Calculating coefficient B for the embodiment of FIG. 5 requires 15*64 +/−/* instructions and 64 division instructions.

The prior approach of FIG. 3 requires 2 mixing filters whereas the embodiments of FIGS. 5 and 6 require only 1 mixing filter. Filter $H_d$ in FIG. 5 ideally is just pure delay. A mixing filter normally has 128 filter taps. So applying each mixing filter requires 64*128 multiplication and 64*128 addition, a further benefit provided by these embodiments. In sum, the computational comparison can be seen shown in Table 1:

TABLE 1

| | FIG. 3 | FIG. 5 | FIG. 6 |
|---|---|---|---|
| Calculate the mic matching filter Hmatch | Required | Required | Required |
| Applying matching filter | 64 * 10 * 2 = 1280 | 0 | 64 * 10 * 2 = 1280 |
| Calculating mixing coefficients | 3 * 7 * 128 + 13 * 64 = 3520<br>And 64 division | Max: 2 FFT<br>3 * 7 * 128 + 15 * 64 = 3648<br>And 64 division<br>Min: 0 FFT<br>1 * 7 * 128 + 15 * 64 = 1856<br>And 64 division | Max: 2 FFT<br>3 * 7 * 128 + 12 * 64 = 3456<br>And 64 division<br>Min: 0 FFT<br>1 * 7 * 128 + 12 * 64 = 1664<br>And 64 division |
| Applying the mixing filter | 64 * 128 * 2 * 2 = 32768 | 64 * 128 * 2 = 16384 | |

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A device for wind noise reduction and spatial noise reduction, the device comprising:

a first microphone for capturing a nominal speech signal;

a second microphone for capturing a nominal noise signal;

a generalised sidelobe canceller for spatial noise reduction, comprising:

a blocking matrix filter configured to adaptively process the nominal speech signal to produce a speech cancellation signal;

a first subtraction node for subtracting the speech cancellation signal from the nominal noise signal to produce a noise reference signal;

a noise cancellation filter configured to adaptively filter the noise reference signal to produce a noise cancellation signal; and a second subtraction node for subtracting the noise cancellation signal from the nominal speech signal to produce a speech reference signal; and a wind noise reduction module for wind noise reduction, the wind noise reduction module comprising at least one filter derived from the blocking matrix filter of the generalised sidelobe canceller;

wherein the wind noise reduction module operates on signals derived from the noise reference signal and the speech reference signal of the generalised sidelobe canceller.

2. The device of claim 1 wherein microphone matching is performed by applying a microphone matching filter $H_{match}$ to the noise reference signal, and wherein $H_{match}$ is derived by inverting an adaptive block matrix filter $H_{BM}$.

3. The device of claim 2 wherein $H_{match}$ is scaled by a weight B, B being derived to minimise a power of an output signal of the wind noise reduction module.

4. The device of claim 3 wherein a filter $H_d$ is applied to the speech reference signal by the wind noise reduction module, the filter $H_d$ comprising a short filter or a pure delay.

5. The device of claim 1 wherein microphone matching is effected by the at least one filter of the wind noise reduction module and wherein no separate microphone matching module is provided.

6. The device of claim 1 further comprising a wind noise detector, and wherein the speech reference signal is passed to an output when wind is not detected, and wherein an output of the wind noise reduction module is passed to the output when wind is detected.

7. The device of claim 1 wherein microphone matching is performed by applying a microphone matching filter $H_{match}$ to an output of the wind noise reduction module, wherein $H_{match}$ is derived by inverting an adaptive block matrix filter $h_{BM}$, and wherein inputs to the wind noise reduction module comprise the speech reference signal filtered by $h_{BM}$ and the noise reference signal, and wherein the wind noise reduction module applies a weight B to the noise reference signal before mixing the inputs.

8. A method for wind noise reduction and spatial noise reduction, the method comprising:

capturing a nominal speech signal from a first microphone;

capturing a nominal noise signal from a second microphone;

providing a generalised sidelobe canceller for spatial noise reduction which performs the steps of:

adaptively processing the nominal speech signal with a blocking matrix filter, to produce a speech cancellation signal;

subtracting the speech cancellation signal from the nominal noise signal to produce a noise reference signal;

adaptively filtering the noise reference signal with a noise cancellation filter, to produce a noise cancellation signal; and subtracting the noise cancellation signal from the nominal speech signal to produce a speech reference signal; and applying wind noise reduction by operating on signals derived from the noise reference signal and the speech reference signal of the generalised sidelobe canceller, wherein the wind noise reduction is applied using at least one filter derived from the blocking matrix filter of the generalised sidelobe canceller.

9. The method of claim 8 further comprising performing microphone matching by applying a microphone matching filter $H_{match}$ to the noise reference signal, and wherein $H_{match}$ is derived by inverting an adaptive block matrix filter $H_{BM}$.

10. The method of claim 8 further comprising effecting microphone matching by the at least one filter derived from the blocking matrix filter, and wherein no other microphone matching is performed.

11. The method of claim 8 further comprising detecting wind noise, and wherein the speech reference signal is passed to an output when wind is not detected, and wherein an output of the wind noise reduction module is passed to the output when wind is detected.

12. The method of claim 8 wherein microphone matching is performed by applying a microphone matching filter $H_{match}$ to an output of the wind noise reduction step, wherein $H_{match}$ is derived by inverting an adaptive block matrix filter $h_{BM}$, and wherein inputs to the wind noise reduction comprise the speech reference signal filtered by $h_{BM}$ and the noise reference signal, and wherein the wind noise reduction applies a weight B to the noise reference signal before mixing the inputs.

13. A system for wind noise reduction and spatial noise reduction comprising a processor and a memory, the memory containing instructions executable by the processor and wherein the system is operative to capture a nominal speech signal from a first microphone;

capture a nominal noise signal from a second microphone;

provide a generalised sidelobe canceller for spatial noise reduction which performs the steps of:

adaptively processing the nominal speech signal with a blocking matrix filter, to produce a speech cancellation signal;

subtracting the speech cancellation signal from the nominal noise signal to produce a noise reference signal;

adaptively filtering the noise reference signal with a noise cancellation filter, to produce a noise cancellation signal; and subtracting the noise cancellation signal from the nominal speech signal to produce a speech reference signal; and apply wind noise reduction by operating on signals derived from the noise reference signal and the speech reference signal of the generalised sidelobe canceller, wherein the wind noise reduction is applied using at least one filter derived from the blocking matrix filter of the generalised sidelobe canceller.

14. The system of claim 13 further configured to perform microphone matching by applying a microphone matching filter $H_{match}$ to the noise reference signal, and wherein $H_{match}$ is derived by inverting an adaptive block matrix filter $H_{BM}$.

15. The system of claim 14 configured to scale $H_{match}$ by a weight B, B being derived to minimise a power of an output signal of the wind noise reduction.

16. The system of claim 15 configured to apply the wind noise reduction by applying a filter $H_d$ to the speech reference signal, the filter $H_d$ comprising a short filter or a pure delay.

17. The system of claim 7 further configured to effect microphone matching by the at least one filter derived from the blocking matrix filter, and wherein no other microphone matching is performed.

18. The system of claim 13 further configured to detect wind noise, and to pass the speech reference signal to an output when wind is not detected, and to pass an output of the wind noise reduction module to the output when wind is detected.

19. The system of claim 13 further configured to perform microphone matching by applying a microphone matching filter $H_{match}$ to an output of the wind noise reduction step, and to derive $H_{match}$ by inverting an adaptive block matrix filter $h_{BM}$, and further configured to use as inputs to the wind noise reduction the speech reference signal filtered by $h_{BM}$ and the noise reference signal, and further configured to apply a weight B to the noise reference signal before mixing the inputs.

20. The system of claim 13 wherein the system is selected from one of the following: a headset, an earbud, and a smartphone.

* * * * *